United States Patent [19]

Canalizo

[11] 4,437,514

[45] Mar. 20, 1984

[54] DEWATERING APPARATUS

[75] Inventor: Carlos R. Canalizo, Dallas, Tex.

[73] Assignee: Otis Engineering Corporation, Dallas, Tex.

[21] Appl. No.: 389,259

[22] Filed: Jun. 17, 1982

[51] Int. Cl.[3] ..... E21B 34/16; E21B 43/12

[52] U.S. Cl. ..... 166/53; 166/72; 166/372; 137/155; 417/116

[58] Field of Search ..... 166/372, 370, 373, 374, 166/375, 369, 72, 319, 320, 321, 322, 265, 53; 137/155; 417/109, 116

[56] References Cited

U.S. PATENT DOCUMENTS

| | | | |
|---|---|---|---|
| 3,075,475 | 1/1963 | Otis | 417/109 |
| 3,324,803 | 6/1967 | Kelley et al. | 137/155 |
| 3,362,347 | 1/1968 | Canalizo | 137/155 |
| 3,543,848 | 12/1970 | Garrett | 166/319 |
| 3,580,333 | 5/1971 | Douglas | 417/109 |
| 3,613,712 | 10/1971 | Garrett | 137/155 |
| 4,295,795 | 10/1981 | Gass et al. | 137/155 |

FOREIGN PATENT DOCUMENTS

| | | | |
|---|---|---|---|
| 37286 | 12/1908 | Austria | 166/265 |
| 840791 | 5/1970 | Canada | 166/322 |

*Primary Examiner*—Stephen J. Novosad
*Assistant Examiner*—Hoang C. Dang
*Attorney, Agent, or Firm*—Vinson & Elkins

[57] ABSTRACT

Method and apparatus for dewatering a gas well in which the level of water in the well may be maintained at a fairly constant low level employing a diverter valve for introducing liquid into the tubing which valve is maintained closed when the liquid level drops below a selected level and employing a fluid responsive gas lift valve utilizing annulus gas to lift the liquid within the tubing from the well. The fluid operated valve may be closed by a constant force exerted on the valve member toward closed position or the force urging the valve member to closed position may be increased in response to a reduction in pressure in the annulus to close the gas lift valve when the annulus pressure reduces to a selected level.

5 Claims, 5 Drawing Figures

DEWATERING APPARATUS

This invention relates to methods and apparatus for removing liquids, principally water, from gas wells.

A standard method of removing liquid from a gas well is to have a valve at the surface, regulated by a timer and sometimes called a stop cock, which will open the tubing at the surface and allow gas pressure to blow any liquids which have accumulated in the lower portion of the well out through the tubing. Sometimes a plunger can be used to remove the liquid but frequently there will be nothing other than an open string of tubing with the liquid at the same height within the tubing as in the casing. This arrangement results in a column of high pressure gas being trapped between the stop cock on the surface and the liquid in the well bore. When the stop cock opens, this column of gas is discharged and will be wasted unless recovered by additional separation and recovery equipment at the well surface.

The present invention minimizes the amount of gas used to discharge liquid from the well bore. All gas used in the present system actually lifts the liquids. In a typical well installation the stop cock valve is controlled by a mechanical timer which must be wound by the pumper or a controller which uses gas. The present invention utilizes a controller that operates only on the pressure of formation gas and the pressure within a charged dome and does not require a timer to function properly.

In carrying out the invention, a diverter valve is utilized to control flow of liquids into the tubing and is so arranged that gas is not permitted to pass through the diverter valve. Thus the only gas which will be present in the tubing above the liquid level area is gas which has separated out from the liquid.

The liquid is lifted by a separate fluid operated gas lift valve which may be controlled by a fixed force such as a closed pressure dome or which may be controlled by a system responsive to annulus pressure.

A control system for a gas lift valve which changes the pressure in the pressure dome of the gas lift valve in response to changes in annulus pressure at the surface is shown in my U.S. Pat. No. 3,362,347. This system does not employ a diverter valve and as the system in my patent is directed to lifting oil in a producing oil well, gas from such oil well would be traditionally treated in a separator and it would be expected that there would be enough gas in the field to make it economical to separate and utilize the produced gas. On the other hand, in gas wells, the fluid lifted is primarily water which has no value and gas utilized to lift such water is normally not recovered. It is therefore desirable to minimize the amount of gas which is lost through the tubing or siphon lines. The control system illustrated in the present invention further differs from my patent in that the dome pressure in the gas lift valve is maintained at a selected value while liquid is accumulating in the tubing instead of varying with annulus pressure as disclosed in my U.S. Pat. No. 3,362,347. To be able to maintain a low liquid level in a gas well, it is preferred that the dome pressure in the gas lift valve return to or be maintained at a selected value for opposing the opening force resulting from the hydrostatic head of liquid in the tubing.

It is an object of this invention to provide a dewatering method and apparatus for gas wells in which, other than gas coming out of solution, all gas flowing through the tubing is utilized to lift liquids in the tubing.

Another object is to provide a method and system for maintaining a low liquid level in a gas well while preventing gas from being lost through the tubing other than gas utilized to lift fluids in the tubing.

Another object is to provide a method and apparatus for dewatering gas wells in which flow of liquids into the tubing is controlled by a diverter valve which will be closed when the liquid level drops to the inlet of the diverter valve to prevent gas passing therethrough and in which lifting gas is introduced through a fluid operated gas lift valve to lift fluid from the tubing.

Another object is to provide a method and apparatus for dewatering gas wells employing a diverter valve controlling flow of liquid into the tubing in which a simple balance line having liquid therein is employed to close the diverter valve when the liquid level in the annulus drops to a selected level below the liquid level in the balance line.

Another object is to provide a dewatering system and method for gas wells in which a controller system is utilized which maintains the pressure within the operating dome of the gas lift valve at a selected value while liquid is building up in the tubing and which, in response to a reduction in pressure in the annulus, increases the pressure in the dome of the gas lift valve to close the valve, which pressure is then bled off and the pressure within the dome returned to the desired pressure for operating the gas lift valve in response to the pressure of the liquid within the tubing.

Another object is to provide a dewatering apparatus utilizing a diverter and gas lift valve in which the two valves are landed in the tubing and a bypass is provided between the lower valve and the tubing above the upper valve and wherein provisions are made for introducing through the tubing and into the ports in the valves the various fluids necessary to the operation of the system.

Other objects, features and advantages of the invention will be apparent from the drawings, the specification and the claims.

In the drawings wherein illustrative embodiments of this invention are shown and wherein like reference numerals indicate like parts:

In practicing the method of this invention, a gas well is equipped with the conventional flow tube or siphon line. The well is equipped adjacent the producing formation with a diverter valve and a fluid operated gas valve.

In order that formation gas may be utilized to lift liquids from the well, a check valve preventing back flow of sales gas is provided at the wellhead.

Liquids are permitted to rise in the well and as they rise to a selected level, the diverter valve opens to permit flow of liquid into the siphon tube. As the annulus level drops, the diverter valve will close. This cycle continues until a sufficient level of liquid is present in the tubing to exert a pressure on the fluid operated gas lift valve which will move the gas lift valve to open position. When this occurs, annulus gas will U-tube the liquid in the annulus through the gas lift valve into the tubing and will thereafter flow through the gas lift valve into the tubing and lift the liquids therein to the surface. As the check valve prevents back flow of sales gas into the annulus, the annulus pressure will drop. Due to the reduction of annulus pressure and/or tubing pressure at the gas lift valve, the valve will close and the cycle will be repeated. During the lifting cycle, the diverter valve will have closed in response to the liquid level falling in the annulus to a selected level above the inlet to the diverter valve preventing gas from flowing through the diverter valve into the tubing ensuring that the lifting gas may be controlled by passing solely through the gas lift valve to prevent wasting of gas. Thus, the only gas flowing through the siphon line is that utilized to lift fluid within the siphon line.

In accordance with one form of this invention, a control system is provided for the dewatering system which control system senses a reduction in pressure in the tubing-casing annulus and upon sensing this reduction in pressure opens a flow passageway to introduce higher pressure gas into the dome of the gas lift valve to force the gas lift valve to closed position. This higher pressure gas may be either sales gas downstream from the check valve or it may be annulus gas. Thereafter, the control system bleeds off the high pressure gas from the dome of the gas lift valve and regulates the pressure in the dome to a selected value to again return the gas lift valve to conditions selected for opening of the valve in response to the height of the liquid in the tubing reaching a preselected level.

Figure 1:
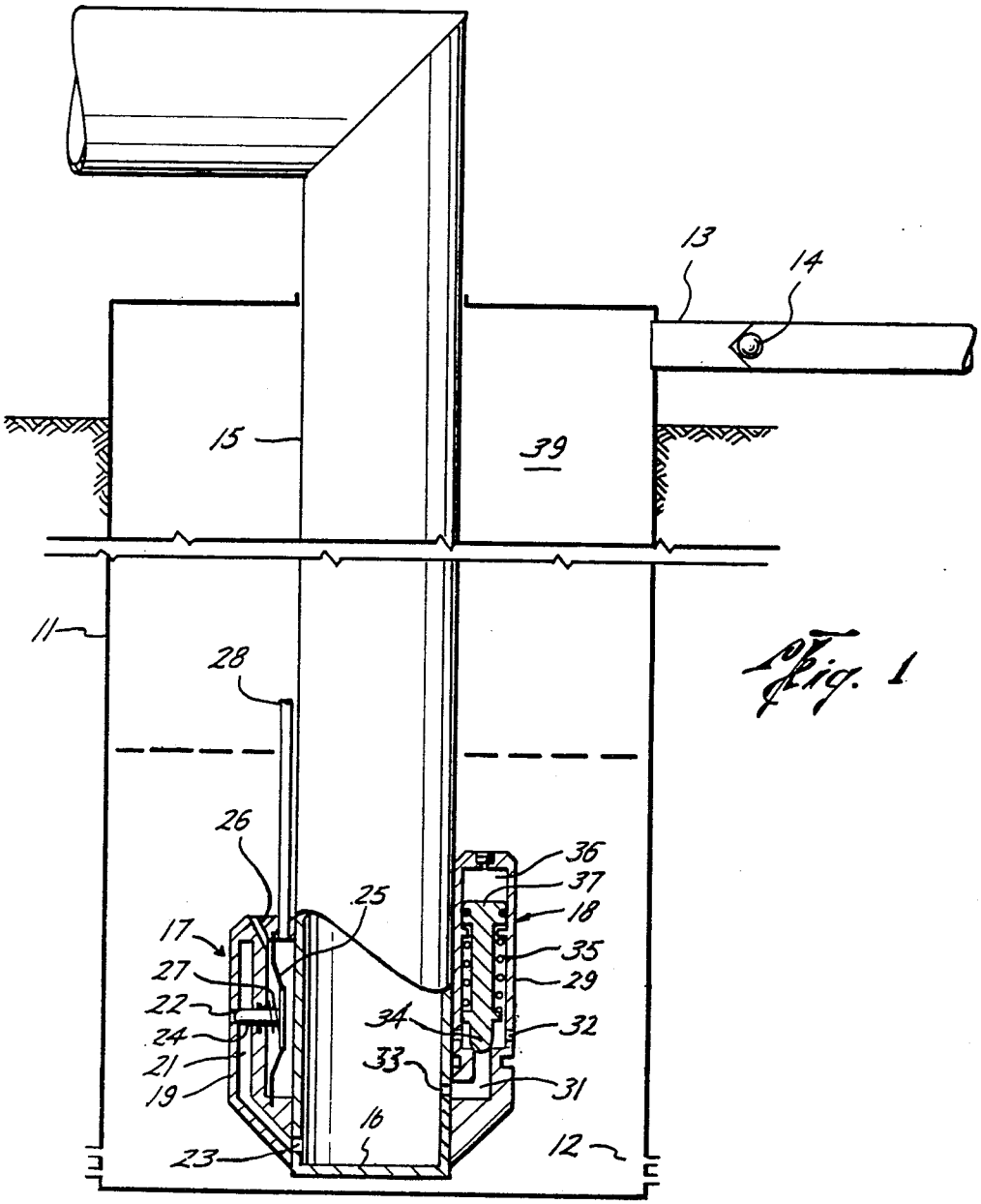
FIG. 1 is a schematic illustration of a dewatering system in accordance with this invention.

Referring now to FIG. 1, a gas well is illustrated having a casing 11 producing gas from formation 12. The produced gas exits the casing through the sales gas line 13. To prevent back flow into the annulus during the lifting cycle, a back check valve 14 is provided in the outlet from the casing annulus.

A flow tube or siphon line 15 is provided in the well and extends down to approximately the level of formation 12. The flow tube is closed at 16 so that liquid may only enter the tube 15 through the diverter valve indicated generally at 17 and the gas lift valve indicated generally at 18.

Referring first to the diverter valve 17, a housing 19 has a flowway 21 therethrough with inlet 22 communicating with the tubing-casing annulus and the outlet 23 communicating with the tubing 15. The inlet 22 provides a valve seat with which the valve member 24 cooperates to control flow through the flowway 21. The valve member is controlled by a pressure responsive member such a diaphragm 25 which is secured to valve member 24. A port 26 in the housing exposes the diaphragm to annulus fluid adjacent the diverter valve on its side adjacent to the seat so that the pressure of the hydrostatic head of liquid in the annulus urges the diaphragm and valve member towards the valve open position. Also, a small spring 27 may be utilized to additionally urge the diaphragm toward valve opening position.

The diaphragm is urged toward valve closing position by a constant force which may be supplied in any desired manner. Preferably, a stand pipe or balance line 28 extends upwardly from the housing and communicates with the side of the diaphragm remote from the valve seat 22. The balance line 28 contains liquid and may extend above the liquid level in the annulus to the level necessary to provide through the liquid therein a hydrostatic head of fluid which will exert the desired force on the diaphragm to close the diverter valve. Obviously, the pressure of the gas in the annulus is applied equally to both the column of liquid in the annulus and the column of liquid in the balance line 28, so fluctuations in the gas pressure, understandably, do not affect the action of the diaphragm 25 which is responsive to the differential pressure resulting from the difference in the hydrostatic head of the two columns of liquid acting on its opposite sides. The strength of the spring 27 and the height of the liquid within the balance line 28 will be selected to ensure that the diverter valve will always be closed before the liquid level within the annulus drops to the level of the inlet to the diverter valve. In this way, it is ensured that no gas will pass through the diverter valve and all lift gas must go through the gas lift valve 18. This prevents waste of gas which would occur if gas were permitted to pass through the diverter valve. The selection of forces for operating the diverter valve preferably are such that the liquid level within the annulus will have a relatively small variation and will not rise to substantial heights to minimize the back pressure on the formation 12.

Referring now to the gas lift valve 18, the valve has a housing 29 with a flowway 31 therein with its inlet 32 exposed to the annulus and its outlet 33 leading into the flow tubing 15.

The valve 18 has a valve member 34 therein which cooperates with a seat in the flowway to control flow through the gas lift valve. The spring 35 urges the valve toward seated position and is assisted by a charge of fluid under pressure in the dome 36 of the gas lift valve. The dome is closed by a piston 37 having a suitable seal such as an O-ring for sliding engagement with the internal wall of the dome 36.

In operation, liquids rise in the annulus 39 as indicated in the drawing to a level above the diverter valve 17. When the force exerted by the rising liquid and the spring 27 exceeds the force exerted by the head of fluid in the balance line 28, the diverter valve opens and liquid within the well flows into the tubing 15. As the liquid level drops, the diverter valve will close. The liquid will again rise and the cycle will be repeated. Thus, the liquid level within the annulus 39 during normal flowing of the well will remain at a substantially constant level and exert a substantially constant back pressure on the formation 12. As the liquid level in the annulus rises to exceed the selected upper level, the diverter valve will open and fluid will flow into the tubing until the liquid level in the annulus drops to the selected lower level. This cycle will continue until the liquid level within the tubing increases to a level at which the hydrostatic head of liquid in the tubing exerts a force on the valve member within the seat provided by the flowway 31 in a direction to unseat the valve which in cooperation with the pressure on the piston 37 due to the annulus pressure and the hydrostatic head of liquid in the annulus urging the valve toward open position, exceeds the force exerted by pressure within the dome 36 and the force of spring 35. When this occurs, the valve member 34 will move to open position and the entire valve member will be exposed to pressure conditions in the annulus. This will maintain the valve member open while liquid within the annulus is U-tubed into the tubing to uncover the inlet 32 of the gas lift valve to gas within the annulus. This gas will then flow into the tubing to lift the liquids therein. As the ball check valve 14 in the sales gas line prevents back flow of gas the lifting gas leaving the annulus will cause the pressure therein to drop which will reduce the pressure on the piston 37 urging the valve toward open position permitting the valve to close. The cycle is then repeated.

Figure 2:
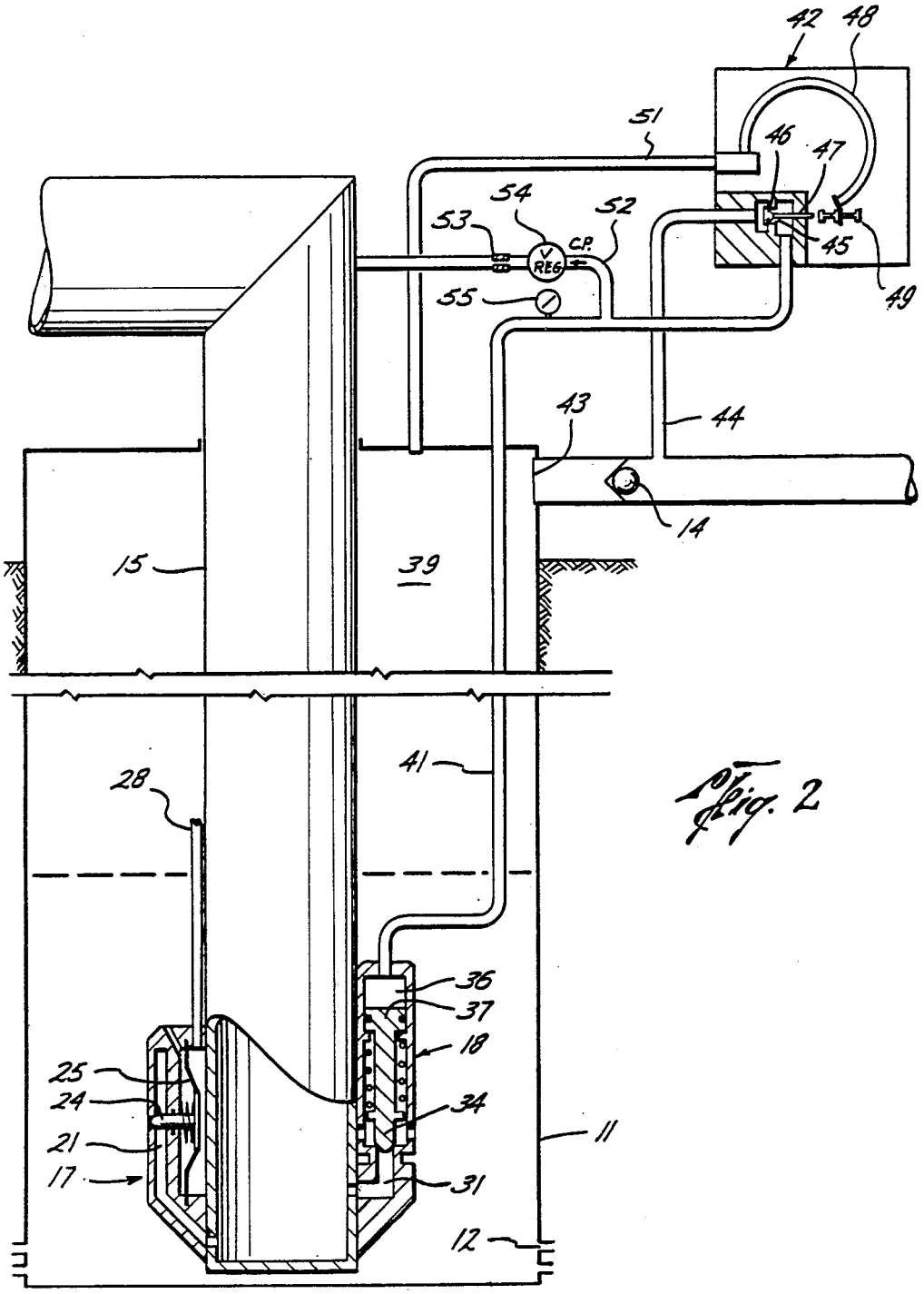
FIG. 2 is a schematic illustration of a dewatering system of this invention utilizing a surface controller.

In FIG. 2, the dewatering system is shown with an identical diverter and a gas lift valve which differs from the valve 18 only in that the pressure within the dome may be varied through the line 41 which extends to the surface.

A control system is provided for controlling the pressure within the dome through the line 41. This control system includes a controller indicated generally at 42 for controlling flow of gas from the outlet 43 of the annulus 39 through conduit 44 and 41 to provide increased gas pressure for moving the valve member 34 of the gas lift valve to closed position.

The controller has a valve seat 45 with which the valve member 46 cooperates to control flow through the conduits 41 and 44. The valve member 46 carries a valve stem 47 for actuating the valve.

To control the position of the valve member 46, the controller has a pressure responsive means which is responsive to pressure within the annulus 39. Conveniently, this means may be a Bourdon tube 48 which with an increase in pressure expands away from the valve stem 47 and with a decrease in pressure contracts into contact with the stem 47 to unseat the valve member 46 from the seat 45. Preferably, the Bourdon tube carries an adjustable magnet 49 which, when the Bourdon tube expands, will pull the valve back onto its seat before releasing the valve stem. With the valve on its seat, the differential across the valve 46 will maintain it on its seat. Pressure from the annulus 39 for operating the Bourdon tube 46 is supplied through the conduit 51.

After the valve 46 is closed, the pressure within the pressure dome 36 of the gas lift valve should be reduced to its normal operating pressure. For this purpose, the conduit 41 has a branch conduit 52 which has its outlet connected to the flow tube 15. A choke 53 and a back pressure regulator valve 54 are arranged in series in the conduit 52 with the choke downstream of the regulator. A suitable gauge 55 may be provided in the line 41 if desired.

In operation, the diverter valve will introduce liquid into the tubing 15 as explained in conjunction with the FIG. 1 form. With the dome 36 at the pressure maintained by the back pressure regulator 54, the system will permit accumulation of liquid in the tubing 15 until the valve 34 is opened in the manner previously explained. As the liquid is lifted from the tubing 15 and the annulus pressure drops to a selected value at the end of the lifting cycle, the Bourdon tube 48 will contract and unseat valve 46. When this occurs, the pressure at the outlet of the annulus will flow through conduits 44 and 41 into the dome of valve 36 to increase the pressure in the dome and seat the valve 34. Upon closing of the gas lift valve, the pressure within the annulus 39 will increase to a value at which the Bourdon tube 48 expands to close valve 46. Upon this occurring, the flow of gas from the annulus outlet is stopped. In order to return the pressure in dome 36 to the pressure desired for opening of the gas lift valve, the regulator 54 bypasses this excess gas pressure into the tubing 15. As the back pressure regulator would be open during the time that the controller valve 45 is open and gas would be lost through the regulator 54 a choke 53 is provided to limit the amount of gas that flows through the bypass line 52 and limit the loss of gas. As soon as the pressure within line 41 drops to the set value of the regulator 54, the regulator will close and maintain in the dome 36 of the gas lift valve the desired pressure for operating the gas lift valve in response to the pressure of liquid in the tubing 15. Thereafter the cycle is repeated.

In FIG. 2, the line 44 for delivering gas to the controller is shown to be downstream of check valve 14. It is desirable to so position the line particularly when the annulus is subjected to a large draw down so that adequate pressure will always be available to increase the pressure in the dome 36 of the gas lift valve. The check valve could, however, be located down stream of the conduit 44 and annulus pressure relied upon to provide the pressure in the dome 36 as annulus pressure plus the force of spring 35 will normally be larger than the set pressure for operating the gas lift valve 18.

Figure 3A:
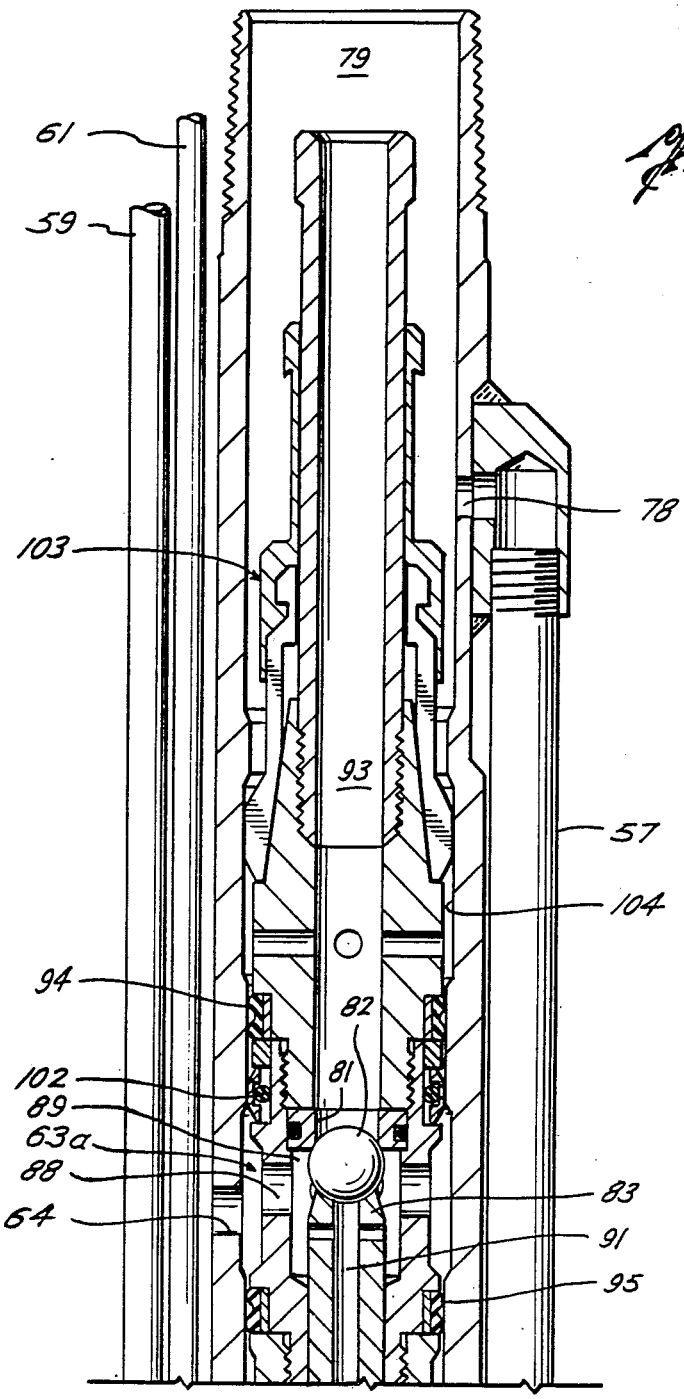
FIGS. 3A and 3B are continuation views in vertical cross-section through a landing nipple or flow tube and combination diverter and gas lift valve constructed in accordance with this invention.
Figure 3B:
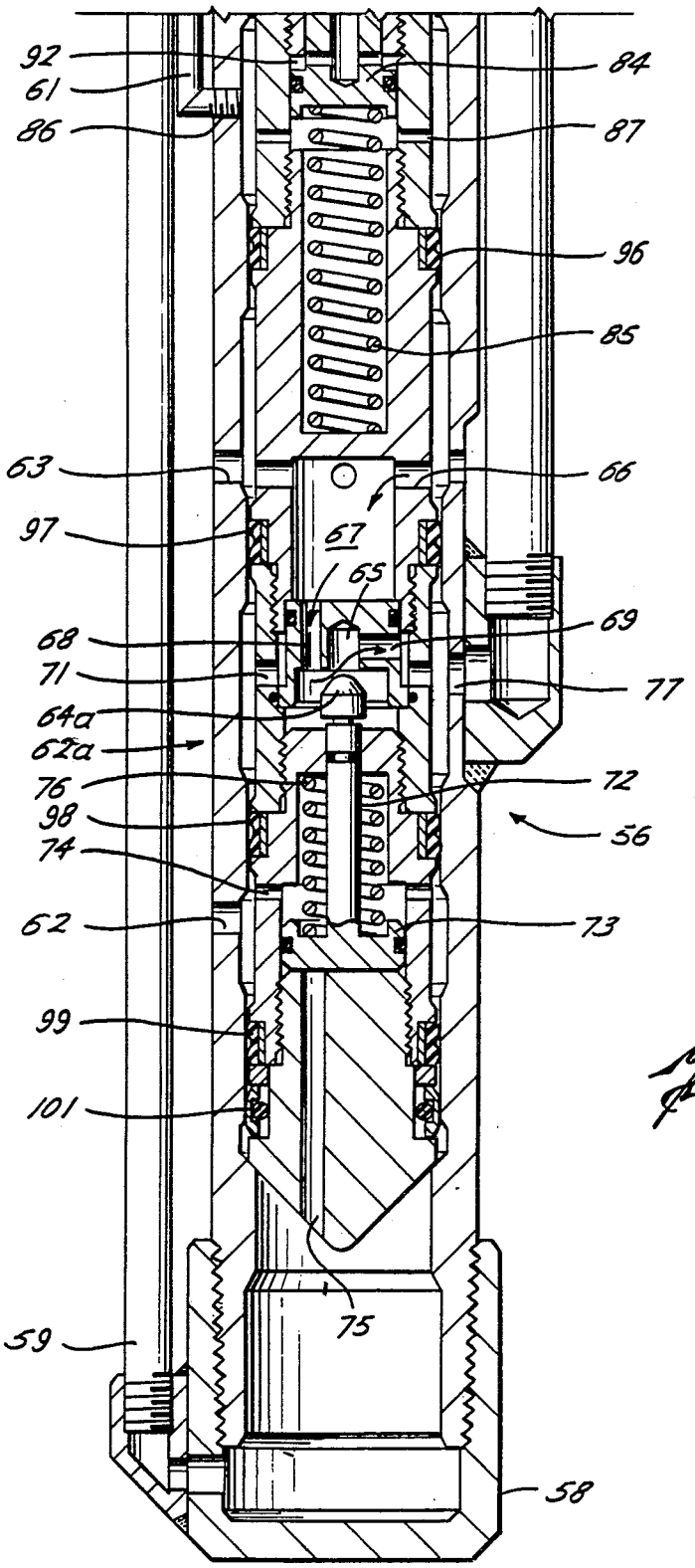

Referring now to FIGS. 3A and 3B, an integral diverter valve and gas lift valve are shown landed in a landing nipple which will be made up on the lower end of a string of tubing.

The landing nipple is provided with multiple lands between flow grooves for engagement by the several seals carried by the valve assembly. The landing nipple is indicated generally at 56 and includes a bypass pipe 57 which communicates the lower of the valves with the tubing above the upper of the valves. The mandrel also includes, at its lower end, a ported cap 58 having the stand pipe 59 extending upwardly therefrom for the purpose hereinabove explained. The conduit 61 extends upwardly from the mandrel and communicates the controller with the dome of the gas lift valve in the same manner as conduit 41 of FIG. 2. Ports 62, 63 and 64 provide for entry of well fluids into the mandrel and to the valves landed therein.

Referring now to the valve assembly, the lower valve indicated generally at **62*a* is the diverter valve and the upper valve indicated generally at 63*a*** is the gas lift valve.

The diverter valve has valve member **64*a* cooperable with seat 65 to control flow through the valve. The flow passageway includes the inlet port 66, chamber 67, passageway 68, outlet passageway 69 and the outlet 71** in the body of the valve.

The valve stem 72 carries piston 73 which is exposed on its upper side through port 74 to annulus pressure and through port 75 to pressure from the stand pipe 59. A suitable spring 76 urges the valve toward open position.

As in the case of the previously discussed valves, as the pressure within the annulus increases, the pressure entering through port 74 urges the piston 73 toward valve opening position. This force is augmented by the force of spring 76 and is resisted by the force of the hydrostatic fluid in the stand pipe 59 acting through passageway 75 on the piston 73. Thus, the valve **64*a* will open and close in response to increase and decrease of pressure from the hydrostatic head of fluid exterior of the landing nipple 56. Fluid will flow from the outlet port 71 of the valve through the port 77 in the mandrel, thence through bypass 57 to the port 78 in the upper portion of the landing nipple, and thence up through the bore 79** of the nipple into the tubing thereabove.

The gas lift valve 63a includes the seat 81 which cooperates with valve 82 to control flow through the gas lift valve. The valve 82 is carried by valve stem 83 which in turn carries piston 84. The piston 84 is urged towards valve seating position by spring 85.

Control fluid from conduit 61 enters through port 86 in the mandrel and thence through port 87 in the valve body to be effective on the lower side of piston 84 and urge the valve 82 towards closed position. Fluid from the exterior of the mandrel enters through port 64 in the mandrel and thence through port 88 into the valve cavity 89. From the valve cavity 89, the fluid flows through the passageway 91 in the valve stem and into the chamber 92 where it is effective on the piston 84 to urge the piston toward valve opening position. When the valve opens, fluid from chamber 89 flows past the seat 81 into the outlet passageway 93 and thence into the tubing thereabove.

Suitable seals 94, 95, 96, 97, 98 and 99 seal with lands in the bore extending through the landing nipple to direct flow through the passages hereinabove described. Wear rings 101 and 102 are provided at the lower and upper ends of the valve assembly to protect the several seals during the running of the tool.

A suitable latch indicated generally at 103 is provided at the upper end of the tool for cooperation with the latch groove 104 in the landing nipple to lock the valve assembly in place therein.

Figure 4:
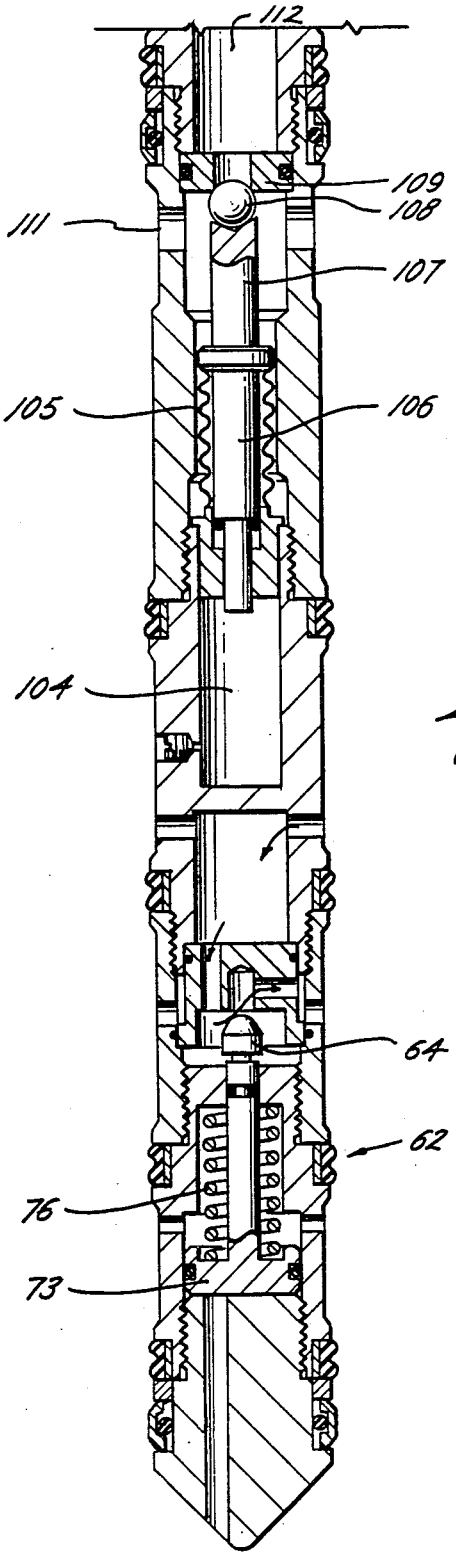
FIG. 4 is a view in vertical cross-section of a diverter valve and gas lift valve with the latch omitted which may be substituted for the diverter valve of FIGS. 3A and 3B.

In FIG. 4, there is shown a combination diverter and gas lift valve which may be utilized when the system is to operate in the manner as shown in FIG. 1, that is, with a fixed charge in the dome of the gas lift valve.

The diverter valve indicated generally at 62 is identical to the diverter valve shown in FIG. 3B. The gas lift valve differs in construction but in function is the same except that charge within the dome pressure chamber 104 remains constant. The charge that is retained within the dome by bellows 105 about the valve stem guide and extension 106. The valve stem 107 carries the valve member 108 which cooperates with seat 109 to control flow entering through inlet 111 and passing through the seat 109 into the bore 112 extending through the latch member which is not shown. The latch member may be the same that is shown in FIG. 3A or any other suitable latch may be employed. The operation of the gas lift valve is the same as explained in FIG. 1 as the pressure within the dome 104 remains constant and the valve member opens and closes in response to pressure entering into port 111 and effective on the bellows 105 and pressure exerted by the hydrostatic head of fluid in the tubing being exerted on the valve member 108 through the area of valve seat 109.

In the FIG. 4 form of valve the conduit 61 from the surface may be omitted and inlet 86 in the mandrel may be plugged.

The foregoing disclosure and description of the invention are illustrative and explanatory thereof and various changes in the size, shape and materials, as well as in the details of the illustrated construction, and various changes in the process may be made within the scope of the appended claims without departing from the spirit of the invention.

What is claimed is:

1. A system for controlling operation of a fluid operated gas lift valve having a pressure dome for lifting liquids in a tubing located in a cased gas well producing through the casing-tubing annulus and through a gas outlet at the wellhead comprising:

a controller having a cooperable valve and valve seat therein controlling flow from the gas outlet of the well to the pressure dome of the gas lift valve;

means in said controller responsive to casing-tubing annulus pressure for opening said valve in response to annulus pressure reducing to a selected value and closing said valve in response to annulus pressure rising to a selected value;

regulator means controlling pressure in said pressure dome when said controller valve is closed;

choke means in series arrangement with said regulator means and positioned downstream thereof limiting flow through the regulator means when open;

means connecting said choke means with said tubing; and check valve means in the gas outlet preventing back flow of production gas into the annulus.

2. A dewatering system for a cased gas well having a tubing located therein and producing through the casing-tubing annulus and through a gas outlet at the wellhead comprising:

a diverter valve for diverting liquids from the well into the tubing comprising, a housing having a flowway therethrough with its outlet communicating with said tubing, a cooperable valve member and valve seat controlling flow through the flowway, a pressure responsive member exposed on one side to pressure exterior of the housing and controlling operation of said valve member in response to changes in pressure exterior of the housing, and means effective on the other side of and urging said pressure responsive member towards valve closed position with a constant force sufficient to maintain the valve member closed when the liquid exterior of the tubing drops below a selected level to prevent lifting gas passing through the diverter valve;

a fluid operated gas lift valve having a pressure dome and having its outlet connected to the tubing for gas lifting liquids diverted to said tubing by said diverter valve; and a control system comprising;

a controller having a cooperable valve and valve seat therein controlling flow from the gas outlet from the well to the pressure dome to the gas lift valve, means in said controller responsive to casing-tubing annulus pressure for opening said valve in response to annulus pressure reducing to a selected value and closing said valve in response to annulus pressure rising to a selected value, regulator means controlling pressure in said pressure dome when said controller valve is closed, choke means in series arrangement with said regulator means and positioned downstream thereof limiting flow through the regulator means when open, means connecting said choke means with said tubing, and check valve means in the gas outlet preventing back flow of production gas into the annulus.

3. The dewatering system of claim 2 wherein the means urging the pressure responsive member towards closed position is a stand pipe having liquid therein in fluid communication with the other side of the pressure responsive member.

4. The dewatering system of claim 2 wherein the diverter valve and gas lift valve are wire line valves landed in said tubing with seal means between the valves and tubing and ports in the tubing arranged to direct liquid to the diverter valve and said one side of the pressure responsive member and fluid to the gas lift valve, and wherein a bypass tube connects the outlet of the lower of said valves with the tubing above the upper of said valves.

5. The dewatering system of claim 2 wherein the diverter valve and gas lift valve are wire line valves landed in said tubing with seal means between the valves and tubing and ports in the tubing arranged to direct liquid to the diverter valve, and to said one side of the pressure responsive member and liquid from the stand pipe to the pressure responsive member and fluid to the gas lift valve, and wherein a bypass tube connects the outlet of the lower of said valves with the tubing of the upper of said valves.

* * * * *